US005934095A

United States Patent [19]

Tyree, Jr.

[11] Patent Number: 5,934,095

[45] Date of Patent: Aug. 10, 1999

[54] VERSATILE LOW TEMPERATURE LIQUID $CO_2$ GROUND SUPPORT SYSTEM

[76] Inventor: Lewis Tyree, Jr., 115 Liberty Hall Rd., Lexington, Va. 24450

[21] Appl. No.: 09/013,318

[22] Filed: Jan. 26, 1998

Related U.S. Application Data

[60] Provisional application No. 60/036,450, Jan. 27, 1997.

[51] Int. Cl.[6] ..... B60H 1/32

[52] U.S. Cl. ..... 62/239; 62/384

[58] Field of Search ..... 62/384, 239

[56] References Cited

U.S. PATENT DOCUMENTS

| | | | |
|---|---|---|---|
| 1,968,504 | 7/1934 | Rufenor et al. | 62/170 |
| 2,180,231 | 11/1939 | Geertz et al. | 62/1 |
| 2,550,886 | 5/1951 | Thompson | 62/1 |
| 2,679,730 | 6/1954 | Kobold | 62/1 |
| 2,798,365 | 7/1957 | Hesson | 62/1 |
| 2,880,594 | 4/1959 | Hesson | 62/54 |
| 3,660,985 | 5/1972 | Tyree, Jr. | 62/10 |
| 3,754,407 | 8/1973 | Tyree, Jr. | 62/55 |
| 4,100,759 | 7/1978 | Tyree, Jr. | 62/55 |
| 4,127,008 | 11/1978 | Tyree, Jr. | 62/62 |
| 4,137,723 | 2/1979 | Tyree, Jr. | 62/64 |
| 4,187,325 | 2/1980 | Tyree, Jr. | 426/510 |
| 4,211,085 | 7/1980 | Tyree, Jr. | 62/48 |
| 4,295,337 | 10/1981 | Johnson et al. | 62/384 |
| 4,377,402 | 3/1983 | Crowe et al. | 62/10 |
| 4,693,737 | 9/1987 | Tyree, Jr. | 62/10 |
| 4,695,302 | 9/1987 | Tyree, Jr. | 62/10 |
| 4,886,534 | 12/1989 | Castan | 62/48.2 |
| 4,888,955 | 12/1989 | Tyree, Jr. et al. | 62/47.1 |
| 5,177,974 | 1/1993 | Uren et al. | 62/47.1 |
| 5,257,503 | 11/1993 | Rhoades et al. | 62/384 |
| 5,335,503 | 8/1994 | Lee | 62/239 |

OTHER PUBLICATIONS

W.R.Kitzmiller "Advantages of $CO_2$–Amonia System for Low Temperatures" POWER Magazine Jan. 19, 1952 pp. 92–94.

*Primary Examiner*—Ronald Capossela

[57] ABSTRACT

A liquid $CO_2$ storage vessel system for user sites, which receives warm $CO_2$ and then cools the liquid $CO_2$ to temperatures below −25° F. before further use. The cooled liquid $CO_2$ can be at temperatures and pressures of near equilibrium conditions or at sub-cooled conditions. Cooling of the liquid $CO_2$ is conducted by $CO_2$ vapor removal from liquid $CO_2$; and is independent from the $CO_2$ use, so cooling can be conducted during both normal and off hours. The storage vessel can be safely filled from most existing delivery vehicles, and the previously cooled liquid $CO_2$ in the bottom of the storage vessel can be prevented from mixing with the warmer being-delivered liquid $CO_2$, so the temperature of the liquid $CO_2$ immediately going to use is little effected by the delivery being conducted.

24 Claims, 6 Drawing Sheets

VERSATILE LOW TEMPERATURE LIQUID $CO_2$ GROUND SUPPORT SYSTEM

CROSS REFERENCE TO RELATED APPLICATIONS

Priority for the present invention is based upon prior filed Provisional patent application, Ser. No. 60/036,450 of Lewis Tyree, Jr. entitled LOW TEMPERATURE LIQUID $CO_2$ GROUND SUPPORT/FILLING SYSTEM filed on Jan. 27, 1997 and Provisional patent application, Ser. No. 60/042,033 of Lewis Tyree, Jr. entitled SIMPLE LOW TEMPERATURE LIQUID $CO_2$ GROUND SUPPORT/FILLING SYSTEM filed on Mar. 28, 1997.

STATEMENT FEDERALLY SPONSORED RESEARCH AND DEVELOPMENT

Not Applicable

BACKGROUND OF THE INVENTION

This invention relates to the apparatus and methods suitable for storage vessel systems typically located at customer or user sites which receive liquid carbon dioxide ($CO_2$) by truck or rail and then supply it to devices where it is expended so as to create a refrigeration effect, and especially useful when creating a low temperature effect of below 0° F., and as low as −110° F.; and such systems, while they may have other beneficial uses, are especially useful as ground support/filling apparatus and arrangement for trucks or rail cars using $CO_2$ for cooling.

Liquid carbon dioxide has long been used both as a working (typically closed cycle) and as an expendable (typically open cycle) refrigerant for many low temperature applications because of a number of factors. Its non-toxicity, its desirably low range of refrigeration temperatures, its positive pressures at low temperatures and its lack of a residue (other than vapor) after having given up its refrigeration effect are among the more important. Dry ice (a solid), at atmospheric pressure, sublimes to a vapor at −110° F. In recent years, $CO_2$'s use as a working refrigerant has declined because of its high condensing pressure at ambient temperatures. However, $CO_2$'s use as an expendable refrigerant has greatly increased. When used as an expendable refrigerant, liquid $CO_2$ is generally stored at a customer site in an insulated pressure vessel under about 300 psig pressure and at a temperature of about 0° F. and then used by the customer in a variety of manners. Most frequently the liquid $CO_2$ is piped to a machine where it is expended. These machines are generally characterized within the $CO_2$ industry as "dispensing devices" or "dispensing equipment." The liquid $CO_2$ within the storage vessel is typically maintained at 0° F. temperature and 300 psig pressure by means of a mechanical refrigeration system (freon, R-404A or similar), where the mechanical system's freon evaporator is a coil located within the storage vessel's ullage volume and the freon condenser is fan cooled by ambient air. By this means, $CO_2$ vapor is able to be condensed to liquid inside the storage vessel, whenever the pressure in the storage vessel rises, for whatever reason, to an undesired level.

In many cooling applications, such as filling the dry ice bunker of a rail car or such, as shown in U.S. Pat. No. 5,660,057 issued to the present inventor, the liquid $CO_2$ (supplied by a ground support/filling system) is then expanded inside the bunker to atmospheric pressure, where it partly turns to a solid, termed $CO_2$ snow (a loose form of dry ice), with a substantial portion of the liquid $CO_2$ flashing to vapor. As shown in the '057 patent, the use of liquid $CO_2$ at a temperature below 0° F. is desirable in such applications because the use of such colder liquid $CO_2$ produces a larger percentage of solid $CO_2$ and a smaller percentage of vapor $CO_2$. Reductions in both $CO_2$ usage of up to about 20% and in filling times are made possible by the use of such colder liquid $CO_2$. In some applications, such as enroute truck cooling, as shown in U.S. Pat. Nos. 4,045,972; 5,267,443 and others, liquid $CO_2$ is carried on board the truck in small tanks, and advantageously at pressures in the range of 110 psig, where its equilibrium temperature is about −50° F.; and each truck's individual small tank must be frequently re-filled. Again, reductions in $CO_2$ usage and much faster filling times would result from the use of $CO_2$ colder than 0° F. While truck and rail car cooling systems especially benefit from a low temperature liquid $CO_2$ ground support/filling apparatus and systems (i.e. a non-mobile/liquid supply system), there are many other uses in diverse applications which would benefit from having colder $CO_2$ available.

While cooling $CO_2$ at a user's site may seem to be a straightforward mechanical refrigeration problem, a number of factors have prevented any wide use. U.S. Pat. No. 4,377,402 issued Mar. 22, 1983 shows a binary cascade (R-13/R-502) mechanical system that cools liquid $CO_2$ as it flows between the storage vessel and the use point. Accordingly, the mechanical refrigeration system must be sized sufficiently large to match the highest instantaneous $CO_2$ flow rate, which results in a very large mechanical system, especially burdensome since the $CO_2$ may only be used a few hours per day. U.S. Pat. No. 3,660,985 issued May 9, 1972 to the present inventor represents a different approach where a small reservoir is filled with colder and depressurized liquid $CO_2$ for intermittent use, but the reservoir having to be repressurized before each use, and again the mechanical refrigeration system must be sized large enough to match the highest instantaneous use rate of the $CO_2$. U.S. Pat. No. 3,754,407 issued Aug. 28, 1973 to the present inventor, illustrates a system for filling remote reservoirs with very cold $CO_2$ from a system that cools the $CO_2$ as it flows from the storage vessel to the remote reservoirs, by means of a binary cascade system ($CO_2$/freon), with the freon system being that typically associated with the storage vessel. But again the size of the mechanical refrigeration system had to be large enough to match the highest instantaneous use rate of the $CO_2$. U.S. Pat. No. 4,693,737 issued Sept. 15, 1987 to the present inventor illustrates a somewhat similar system for filling remote reservoirs, providing cooling by means of a small reservoir containing slush $CO_2$ (a mixture of liquid and solid); maintained by a binary cascade ($CO_2$/- - -) system, with the upper stage being the type typically associated with the storage vessel. U.S. Pat. No. 4,695,302 issued Sept. 22, 1987 to the present inventor illustrates a somewhat similar system, except small tanks on board rail cars are being filled with liquid $CO_2$.

U.S. Pat. No. 4,888,955 issued Dec. 26, 1989 to the present inventor, et al, represents an effort to both eliminate the separate vessels of the earlier solutions and to provide a refrigeration system sized for the average daily use rather than the instantaneous use. Using a vertically oriented storage vessel containing the standard freon type refrigeration unit's evaporator coil in the ullage volume, it maintained a normal storage vessel pressurization of approximately 300 psig, while cooling to near −50° F. the lower portion (producing sub-cooling) in a single storage vessel by creation of a thermocline within the stored liquid $CO_2$. It also used an unusual type binary cascade ($CO_2$/freon) system to cool liquid $CO_2$ removed from the storage vessel to near −50° F. (by direct heat exchange with the freon) and then return the cooled $CO_2$ to the bottom of the storage vessel. The −50° F. $CO_2$ portion was liquid $CO_2$ that had been sub-cooled by a freon unit. The $CO_2$ vapor condensing machinery was the standard refrigeration unit typically associated with and part of the storage vessel and the $CO_2$ portion of the binary cascade system was only used to provide 0° F. liquid $CO_2$ for sub-cooling of the freon after it had been condensed in an ambient heat exchanger. While this system overcame the instantaneous refrigeration sizing shortcomings of the earlier systems; its low temperature freon portion was such that the freon compressor was forced to operate with most difficult compression ratios (in excess of 15) if temperatures as low as −50° F. were to be reached; without considering the temperature approach inefficiency of its −50° F. freon to $CO_2$ heat exchanger.

The nature of $CO_2$, combined with the standard past practices of the industry and the existing plant production and distribution equipment, that is to almost a world-wide standard, all combined to present safety related problems encountered when filling storage vessels containing very low pressure/cold $CO_2$. Most modern liquid $CO_2$ production plants are in fact by-product plants, and being part of a much larger production complex are not readily changed, as are the large fleets of distribution equipment (cars, trucks, etc.). The temperature/pressure at which the liquid $CO_2$ is produced from these plants is typically about −20° F./225 psig, and heat gains to the liquid $CO_2$ during subsequent distribution can raise the temperature/pressure to about 0° F./300 psig, all thus resulting in a wide range of conditions at which liquid $CO_2$ is delivered to the various storage vessels by the trucks or rail cars, designed for these temperatures and pressures. A safety problem has been encountered in the past when delivering $CO_2$ to a storage vessel that contains low temperature-low pressure $CO_2$. This problem occurs, if in transferring the liquid $CO_2$, from the delivery truck or car, the pressure in the receiving vessel is so low, that the liquid $CO_2$ still in the delivery truck or car becomes cooled by depressurization to below the safe operating temperature of the truck or car's material(s) of construction. Typically, liquid $CO_2$ is pumped from the delivery vehicle into the storage vessel, and in the process, $CO_2$ vapor from the storage vessel is forced back into the delivery vehicle through a separate return line. The entrance to this return vapor line is placed sufficiently below the top of the storage vessel to provide the ullage volume necessary for safe operation - so as to not liquid fill the storage vessel.

Another problem encountered in the past was that the change in phase and/or cooling occurring when depressurizing or cooling liquid $CO_2$ can cause various impurities in the liquid $CO_2$ (even if in very minute quantities) to agglomerate and then tend to separate or collect out of the liquid $CO_2$; and unless removed or isolated, cause many problems in the storage vessel system or in the dispensing devices it serves. Such impurities can be in the form of non-condensables or condensables or moisture or hydrates or others, none of which are standard or normal, as they can be specific and peculiar to each individual source of the liquid $CO_2$ or to a specific plant upset, any of which can in turn cause subsequent system or dispensing equipment malfunction.

An additional difficulty is that when utilizing industrial type, air cooled single stage, freon type mechanical refrigeration units for maintaining $CO_2$ vessel temperatures/pressures much below 0° F./300 psig; when lower temperatures/pressures are desired, the pressure ratio of the freon type compressor becomes excessive, and cooling capacity is lost. A currently-used unit loses nearly 35% of its capacity if attempting to reduce the R-404A evaporator temperature from 0° F. to −20° F. In addition, the compressor's performance becomes very sensitive to minor machinery problems.

Accordingly, it is evident that a number of systems have been devised for attempting to overcome some of these potential difficulties and deliver lower temperature $CO_2$ liquid. Other examples of such systems include those shown in U.S. Pat. Nos. 4,100,759; 4,127,008; 4,137,723; 4,187,325; 4,211,085; and 5,177,974. Although some of these systems have worked satisfactorily for specific applications, none have solved all the problems, and consequently, an improved system has been sought. Among the difficulties to be solved are those occasioned by the different logistics of supply and use presented by these different users. Accordingly a system is needed that not only can totally control the temperature/pressure of the liquid $CO_2$ in the storage vessel, but also be readily adaptable to a wide variation in use patterns and thus able to cope with these varied and diverse problems.

$CO_2$ is also useful as a working refrigerant, especially when temperatures in the range of −65° F. to −20° F. are desired, because of its favorable pressure characteristics at those temperatures. Its use as the bottom stage refrigerant in a binary cascade system has been long recognized, but little used.

BRIEF SUMMARY OF THE INVENTION

The present invention provides a versatile method and a system for safely receiving (from existing distribution equipment) liquid $CO_2$ at a range of temperature/pressures into a storage vessel system located at a user site, and that is able to supply to the user either low pressure/low temperature liquid $CO_2$ or to supply high pressure/low temperature liquid $CO_2$. Such systems are normally referred to in the industry as "customer stations"; and includes, in addition to the storage vessel, other equipment that supports the uses of the $CO_2$. Accordingly, in one aspect, the invention is able to reduce, prior to further use, the liquid $CO_2$'s temperature and pressure (in equilibrium) to the extent desired, only limited by the triple point of $CO_2$, so as to create within the storage vessel a substantial body of lower temperature and lower pressure $CO_2$, which could then as one example be available to fill a number of small on-board, transportable tanks for subsequent truck or rail car or container cooling. In another aspect, lower temperature and higher pressure (sub-cooled) liquid $CO_2$ which could then be available, as an example, for rapidly filling dry ice bunkers in rail cars or containers, such as in U.S. Pats. Nos. 4,704,876; 5,168,717 and 5,660,057. In a different application of these aspects, lower temperature and higher pressure liquid $CO_2$ could be available to food chillers or freezers, such as in U.S. Pats. Nos. 4,344,291; 4,350,027; 4,356,707 and 4,878,362. While these applications vary widely both in the condition of the $CO_2$ being used and in the quantity, the system of the present invention is able to accommodate all by merely changing set points or adding units (modules). For instance, a rail car can advantageously require 20,000 lbs. of liquid $CO_2$ within a 30 minute period, and one truck may only require 500 lbs. in 5 minutes, but there can be a number of trucks to fill. In addition, some dispensing devices can well handle sub-cooled liquid $CO_2$ at a variety of pressures, others require specific temperatures and pressures in order to function properly. While the utility of the invention has been described with respect to certain applications, the variety of its capabilities is such that almost any liquid $CO_2$ cooling application where $CO_2$ is used as an expendable refrigerant, could be well served by a variation or combination of these aspects. One special advantage is that the size of the storage vessel and the size of the compressor and refrigeration units and the liquid chill units (modules) are independent of each other. This allows selection of vessel size to include distribution economics and selection of compressor and refrigeration units (modules) to include individual user needs. Accordingly, the use of traditional $CO_2$ support apparatus is not limited, such as pumped loops or pressure building units.

Another advantage is that an inventory of cooled liquid $CO_2$ is maintained in the storage vessel, so as to peak shave short term demands, and allow the use of refrigerating equipment sized for average daily demand, thus allowing the use of smaller sized equipment.

Still another advantage is that the cooling of the liquid $CO_2$ in the storage vessel (and/or in an ancillary vessel) to below its delivery temperature, is accomplished by the removal of gaseous $CO_2$ from that liquid. This allows the cooling of the $CO_2$ to temperatures close to the triple point temperature without fear of turning the $CO_2$ to a solid and creating freeze up problems. In one case, the $CO_2$ vapor is removed from the storage vessel, and then by use of a booster compressor and a single stage closed cycle freon type mechanical refrigeration system, the vapor $CO_2$ is condensed before it is returned to the storage vessel. In another case, liquid $CO_2$ is removed from the storage vessel and then cooled by vapor removal before being returned to the vessel. Again, the $CO_2$ vapor removed is condensed by the freon type mechanical system and returned to the storage vessel. This all can accomplish various results, all so as to manipulate and to control the temperature and pressure of the liquid $CO_2$ remaining in the storage vessel, returning the previously removed $CO_2$ vapor back to the system for use in a process; wherein the $CO_2$ becomes part of the atmosphere (i.e. an expendable or open cycle). Thus, if we characterize refrigeration cycles as closed/working (wherein the refrigerant is recycled within the system), or open/expendable (wherein the refrigerant enters the atmosphere after providing/giving up its refrigeration effect); the present invention could be classified as a variation of a binary cascade, with $CO_2$ as the low side refrigerant; but the low side a hybrid system where the same $CO_2$ is both a self-cooled (by vapor removal) working refrigerant (rejecting its heat to the high side) and an expendable refrigerant with the liquid $CO_2$ in the storage vessel acting as a thermal storage medium. While for ease of explanation, where batch type $CO_2$ cooling apparatus has been shown, continuous type $CO_2$ cooling apparatus can be used without departing from the scope of the invention. Equally, where continuous has been shown, batch could be used. It should be understood that where the term "ground support/filling apparatus" for trucks or rail cars using $CO_2$ for cooling is used, that term as used herein means all the non-mobile systems or apparatus located at the location where liquid $CO_2$ is dispensed, such as occurs when filling the bunker of a refrigerated rail car with dry ice or filling the small tanks of $CO_2$ refrigerated trucks with low pressure $CO_2$, and includes the on-site liquid $CO_2$ storage vessels, refrigeration equipment, stationery freezers at food processing plants, food mixers and includes ground support for other $CO_2$ using devices that perform better or more efficiently when using colder liquid $CO_2$

Figure 1:
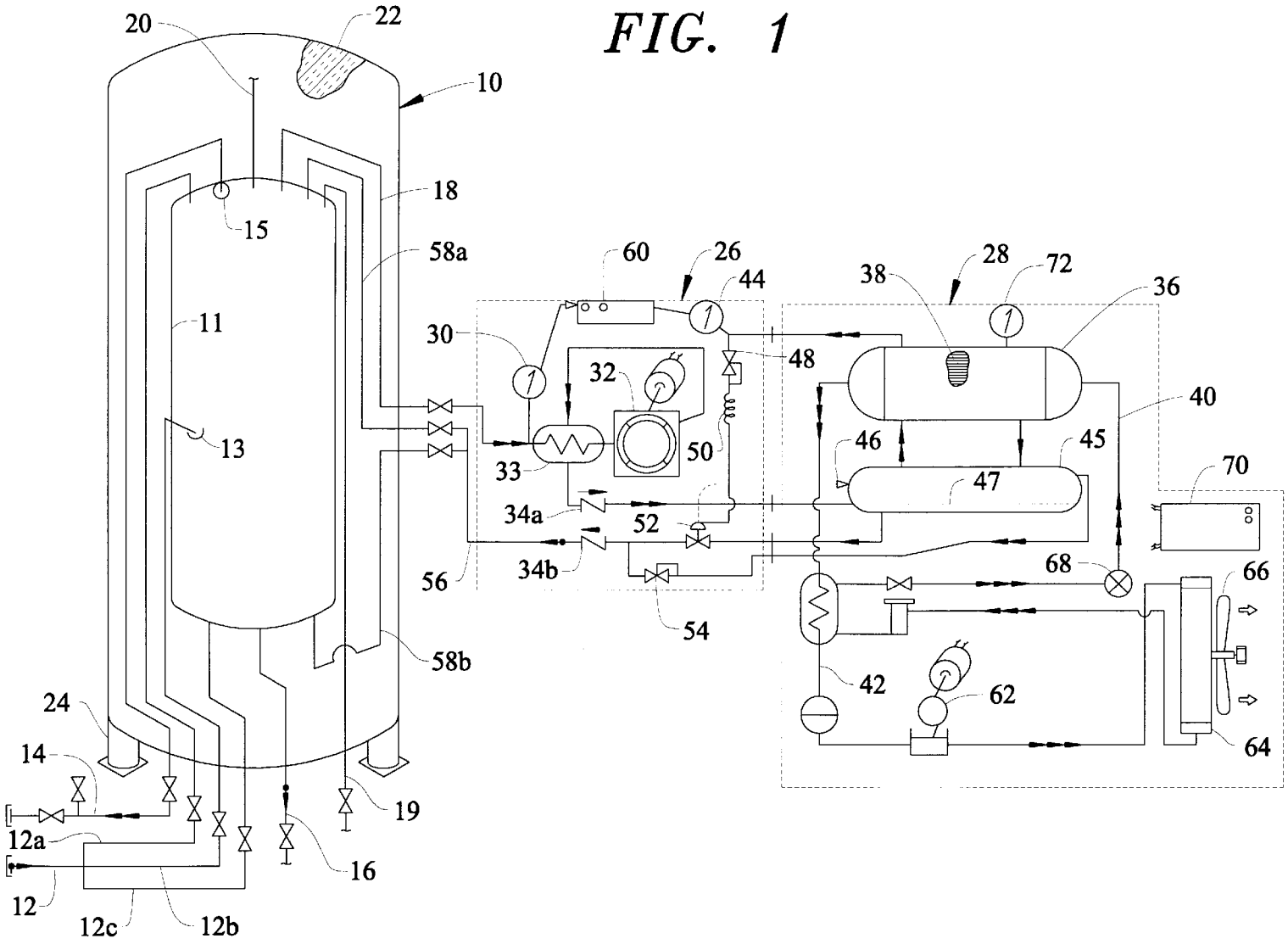
FIG. 1 is a diagrammatic/schematic view of a system embodying various features of the invention with portions broken away and with a number of components shown schematically; the $CO_2$ storage vessel having connections for filling, for use and for condensing $CO_2$ vapor and returning it to the storage vessel as liquid, utilizing a $CO_2$ booster compressor section and a closed cycle mechanical refrigeration section having a $CO_2$ condenser/refrigerant evaporator, a refrigerant compressor, an air-cooled refrigerant condenser and common controls, thus controlling the pressure/equilibrium temperature in the storage vessel. It could be called a hybrid binary cascade system, combining an open lower $CO_2$ stage with a closed refrigerant upper stage.

In the drawings that follow an arrow → represents liquid $CO_2$, and arrow with a circle following the head ●➛ represent liquid $CO_2$ colder than −25° F., a double headed arrow ➛➛ represents vapor $CO_2$, and a triple headed arrow ➛➛➛ represent freon, R-404A, vapor or liquid. Lines and valves of vessel and other element which are duplicated in subsequent figures are given the same identification number in subsequent figures, but with a prime mark (').

DETAILED DESCRIPTION OF THE INVENTION

Illustrated in FIGS. 1, 2, 3, 4, 4A, 4B, 4C, 5, 6 and 6A is a ground support/filling system (or customer station) which includes a storage vessel system to be located at a user's site for delivering liquid $CO_2$ to dispensing devices at various equilibrium and non-equilibrium conditions, generally between about 65 psig and −65° F. and about 300 psig and 0° F. (depending upon the material selection and the MAWP of the specific vessel used). While the system is capable of operating with either horizontal or vertically oriented vessels; it preferably includes a vertically oriented storage vessel 10, with an inner vessel 11 having an interior height greater than its interior width. It is sized to hold a reservoir of liquid $CO_2$ sufficient for the customer needs, such as those using liquid $CO_2$ for truck cooling or other users benefiting from the use of very cold liquid $CO_2$. The inner vessel 11 is suitably insulated so as to maintain the temperatures therewithin at temperatures below 0° F. The inner vessel 11 is made from metals, or other materials suitable for both the temperatures and pressures anticipated.

For purposes of simplifying the figures, some devices, lines and connections to the storage vessel and to other $CO_2$ apparatus standardly provided in the $CO_2$ industry have been omitted, such as for auxiliary liquid and vapor lines, safety relief valves, level/contents device, pressure gauge, clean-out and others. The same is true of the refrigeration apparatus and of the control system.

Very generally, liquid $CO_2$ is supplied to the storage vessel 10 to create a reservoir of liquid $CO_2$ therewithin; in such a 40 foot high vessel (a nominal 50 ton capacity), the initial fill may be to a depth of 35 feet. Following the initial filling of the storage vessel 10, a reservoir of liquid $CO_2$ will generally be at about equilibrium temperature and pressure conditions throughout, for example about 0° F. and 300 psig. Whereas past practice has been to maintain these conditions by the provision of a standard type freon refrigeration unit providing its refrigeration output to pre-sized and built-in condensing coils located in the upper vapor space of the vessel 11; no such coils are provided inside the vessel in this invention, rather providing an external and separate refrigeration unit(s) of various sized matched coils and refrigeration units so as to better match the size and characteristics of the storage vessel 10 as well as all the needs of the diverse users as well as the diverse problems brought about during the changes in temperature/pressure imposed upon the liquid $CO_2$. Inasmuch as the $CO_2$ handled in the $CO_2$ refrigeration cycle co-mingles with the $CO_2$ being expended, where impurities cause many problems, the $CO_2$ compressors are preferably of the non-lubricated type.

Referring to FIG. 1, the invention contains a liquid $CO_2$ storage vessel 10, having an inner vessel 11, which is filled by a transport vehicle (not shown) with liquid $CO_2$ through liquid fill line 12, containing 3 branch lines (12*a*, 12*b* and 12*c*) so that the incoming liquid $CO_2$ can be directed, as desired, to the upper, or intermediate or bottom locations of the inner vessel 11 so as to effect both the pressure in the storage vessel 10 and in the delivery vehicle. A diffuser 13 is placed on the discharge end of line 12*b*, so as to reduce downward mixing action of any liquid $CO_2$ passing through that line. A fill-return line system 14 relieves excess pressure occurring during fill, and in the process also scavenging air and other non-condensables that may have collected, from the top of the inner vessel 11 through a vapor scavenger 15. These non-condeseables will then return to the shipping point for proper disposition. While fill line 12 is depicted dividing into three branch lines, more than one intermediate entry lines (only one shown) could be provided for ease of filling and control of temperature/pressure of the liquid $CO_2$ in both the transport vehicle and the inner vessel 11 during filling operations. A liquid withdrawal line 16 is provided for customer use. Vapor lines 18 and 19 are also provided to be used as desired. Safety relief line 20, having a number of safety related functions, connects to the top of inner vessel 11 and vents elsewhere (not shown). The lines 12*a*, 12*b*, 12*c*, 14, 16, 18, 19 and 20 all connect to inner pressure vessel 11 which is surrounded by suitable insulation 22, and all is supported on legs 24.

A $CO_2$ compressor unit 26 and an air cooled compression type mechanical refrigeration unit 28 cooperatively control the temperature/pressure of the liquid $CO_2$ in storage vessel 10, with the pressure controlled by pressure switch 30, located in compressor unit 26. If the pressure is above the set pressure of pressure switch 30, $CO_2$ compressor 32 is activated, taking $CO_2$ vapor from the top of inner vessel 11 via line 18 and forcing it through suction heat exchanger 33 and check valve 34*a* into refrigeration unit 28. The refrigeration unit 28 contains (in addition to minor/standard items normally provided, and either not identified or shown) $CO_2$ condenser/freon evaporator 36, where freon (or R-404A or the like) cooled refrigeration coils 38 are located, with cold freon produced by refrigeration unit 28 entering coils 38 by means of line 40 and warmed, vaporized freon returning by means of line 42. A pressure switch 44 helps control the compressor 32, so it and the refrigeration unit 28 operate harmoniously. The compressed $CO_2$ vapor, after passing through check valve 34*a*, enters a liquid $CO_2$ sump 45 located within the refrigeration unit 28. Sump 45 is connected to condenser 36 in a manner so $CO_2$ vapor can rise to be condensed therein and after being condensed, flow back down into the sump 45. Level control 46 maintains a desired level of liquid $CO_2$ in sump 45, so that injector 47 is generally covered by liquid $CO_2$. Injector 47 is drilled with a number of small holes so that the $CO_2$ vapor entering the sump 45 is first dispersed and broken into small streams or bubbles, which will become nearly saturated (de-superheated) as they pass through the liquid $CO_2$ in the sump 45, thus allowing the condenser 36 to operate more efficiently.

A line from the upper portion of condenser 36 connects to downstream regulator 48, allowing $CO_2$ vapor to pass through downstream regulator 48, thence through warming coil 50 to pneumatic control valve 52, which functions in a modulating manner, as controlled by level control 46. A back pressure valve 54 maintains the pressure of the $CO_2$ in the condenser 36 and sump 45 at a minimum desired pressure, so that the refrigeration unit 28 (the upper stage) operates more efficiently. By these means, the $CO_2$ liquified in the condenser 36 and which then flowed down into the sump 45, is forced back into vessel 11 through check valve 34*b* and line 56, as controlled by level control 46. Line 56 connects to line 58*a* and to line 58*b*, 58*a* connecting to the ullage volume of vessel 11 and 58*b* connecting to the lower portion of vessel 11. The system thus can be arranged for injection of the liquid vapor $CO_2$ mixture where desired by local circumstances. All being under the logic and control of panel 60.

The purpose of using a pneumatic control for valve 52 (or elsewhere) is twofold, one being the proportioning ability of pneumatics but more importantly, providing a regular scavenge of non-condensables that might otherwise collect in the condenser 36 and gradually block the condensing action of the coils 38, as pneumatic valves vent their operating gas as part of their normal operation. If this amount of purge is not sufficient because of a high amount of non-condensables in the delivered liquid $CO_2$, a line back to vessel 11 can be provided from the top of condenser 36 that periodically opens for a fixed amount of time, and also a manual vent can be provided (both not shown). Additional lines and/or connections and/or devices for control purposes, maintenance or similar needs can be provided for compressor unit 26. A condensable contaminant separator (as explained later) can be located advantageously in line 16 and/or 56 so as to separate and collect for removal any condensables that may have been agglomerated during the cooling process.

Refrigeration unit 28 contains freon compressor 62, condenser 64, which is cooled by ambient air forced through it by fan 66 and expansion valve 68 and control panel 70, which as monitored by pressure switch 72, turns on the refrigeration unit when the $CO_2$ pressure in condenser 36 becomes too high and turns it off when the pressure becomes too low. Other normal devices to such refrigeration units are used but not specifically identified. While a freon is stated as the refrigerant, there are many other choices (such as R-404A) that may be preferred and would operate satisfactorily.

The control panel 60 monitors and controls the various elements of the entire compressor unit 26. By use of this arrangement, $CO_2$ vapor can be withdrawn from the inner vessel 11, raised in pressure by the compressor unit 26, condensed by refrigeration unit 28 and then returned to the inner vessel 11 as a liquid, flashing to a mixture of liquid and vapor as it returns, as the condenser 36 is at a higher $CO_2$ pressure than vessel 11. While compressor 32 has been depicted as a non-lubricated (oil-less) rotary vane compressor, other suitable types can be used; and all control devices could be replaced with other types, such as electronic. Filters etc. can also be included as desired.

Separate compressor units 26 and refrigeration units 28 are not necessarily required, as by appropriate use of piping, valves and controls, the functions could be combined into one unit, but for purposes of clarity, they are described separately herein.

Cold, low pressure accumulated liquid $CO_2$ can be delivered to the user by liquid withdrawal line 16, and an inventory of cold liquid can be maintained during delivery of warmer liquid $CO_2$ to the storage vessel 10 by creation of a thermocline between the inventory and the just delivered liquid $CO_2$.

Figure 2:
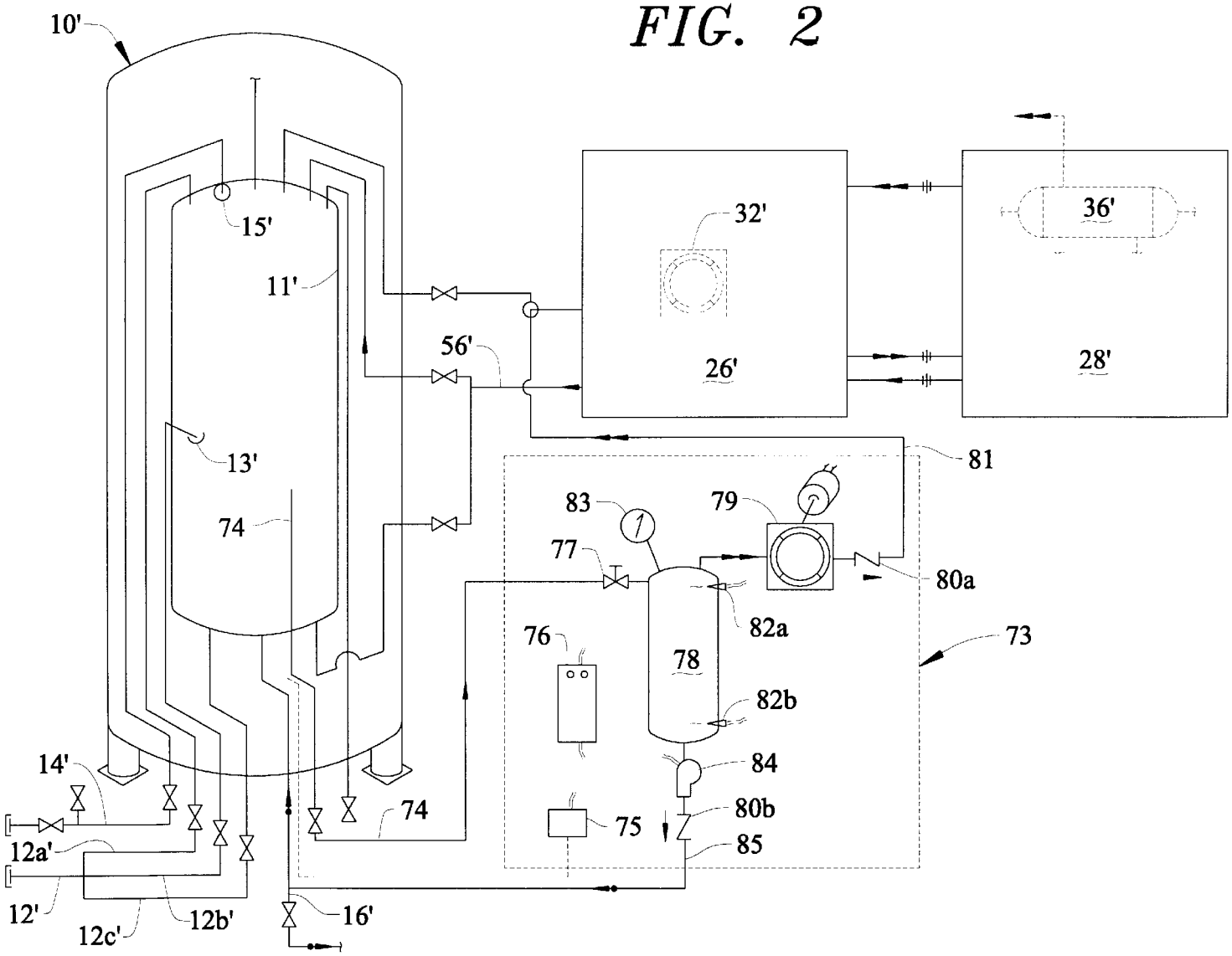
FIG. 2 is a diagrammatic/schematic view of a different variation having the same features as FIG. 1, except a $CO_2$ sub-cooler capable of creating a pool of liquid $CO_2$ at temperatures as low as near −65° F. in the bottom of the principal vessel has been added.

Turning next to FIG. 2, storage vessel system 10', compressor unit 26' and refrigeration unit 28' of FIG. 1 are all depicted, but with a bottom chiller unit 73 added. The bottom chiller unit 73 removes liquid $CO_2$ from the lower portion of inner vessel 11', utilizing line 74. It then cools that liquid $CO_2$ by reducing its pressure, and next returns the cooled liquid to the bottom of vessel 11'; where it is then available for use. A thermocline of warmer, higher pressure liquid $CO_2$ is now above it. By this means, sub-cooled liquid $CO_2$ can be available for a variety of uses. With this variation of the invention, sub-cooled liquid $CO_2$ generally at temperatures in the range of −25° to −69° F. and at pressures in excess of its equilibration pressure by at least 5 psi and up to about 350 psig (or higher, if properly arranged for) can be made available. For instance, the rail car bunker requiring 12 tons of normal (0° F./300 psig) liquid $CO_2$ in 20 minutes, would, if supplied by the bottom chiller of this invention, only require about 9.6 tons of liquid $CO_2$ and would require less time. Line 74's entrance within vessel 11' is located sufficiently high (in this case) that the capacity of inner vessel 11' below the entrance of line 74 is at least 2 ½ tons of liquid $CO_2$ (for a 50 ton capacity vessel). This location, of course, varies for different size vessels (and/or different types of applications); but a reasonable guideline would be approximately between the 5% and 60% full contents points. And if desired, the functions of compressor unit 26', refrigeration unit 28' and bottom chiller unit 73 could be fully or partially combined into one unit, again by the appropriate addition of piping, valves and controls (not shown). Once liquid $CO_2$ is withdrawn from vessel 11', temperature sensor 75 and control panel 76 determine that the liquid $CO_2$ at the sensing point, located near line 74's entrance within vessel 11' (or on vessel 11' at the same location or externally, on line 74), is undesirably warm, valve 77 is caused to open, allowing the warm liquid $CO_2$ to flow into the evaporator tank 78, aided, (as needed) by the suction action of compressor 79 in removing vapor from evaporator 78 (two check valves 80*a* and 80*b* isolate the exits of evaporator 78). and returning it ultimately to the vessel 11' through line 56' (using line 81) then to compressor unit 26' and refrigeration unit 28'. Two level controls, upper 82*a* and lower 82*b* monitor the liquid $CO_2$ level, all being under the logic and control of panel 60. Once upper level control 82*a* determines that the evaporator 78 is full of warm liquid $CO_2$, control panel 76 causes valve 77 to close. Compressor 79 is allowed to continue operating, thus removing vapor from evaporator 78 and thereby cooling the liquid $CO_2$ remaining in the evaporator 78 by evaporative cooling and monitored by pressure controller 83. Since this liquid-vapor mixture is at equilibrium as it cools, the pressure thereof determines the temperature thereof. Once the desired conditions, as set on the control panel 76, are reached, pump 84 is actuated thereby forcing the cooled liquid $CO_2$ through check valve 80*b* and line 85, which joins line 16' for return to the bottom of vessel 11', all until lower level control 82*b* determines that the cycle is complete. If desired valve 77 can be of the proportioning type, and once evaporator tank 78 contains liquid reduced to the desired pressure, admission of liquid $CO_2$ through valve 77 can be proportioned to match the vapor removal needs of the compressor 79. Additionally, the pump 84 can, if desired, be replaced by a batch pressurization transfer system, using high pressure $CO_2$ vapor from the condenser 36' (not shown). This cycle is repeated until temperature sensor 75 determines its setting satisfied, or until control panel 76 determines the liquid level in the vessel 11' is near the entrance of line 74 (not shown) and so signals. This method of evaporative cooling of the bottom portion of the liquid $CO_2$ inventory in vessel 11', which is the portion first withdrawn by the user, tends to provide needed system response during period of heavy liquid $CO_2$ use or immediately after truck or car fills with warm liquid $CO_2$. A moving thermocline responds to both the actions of users withdrawing cold liquid $CO_2$ and the creation of cold liquid $CO_2$ by chiller unit 73. Compressor unit 26' and refrigeration unit 28' continue to operate independently, if needed to limit the pressure of vessel 11' (partially shown). If the pressure of vessel 11 ' becomes too low, $CO_2$ vapor from the condenser 36' can be supplied and/or a vaporizer standard to the $CO_2$ industry can be utilized (not shown). Should compressors capable of high ratios be used (or for other reasons) compressor 32 can perform the duties of compressor 79.

Figure 3:
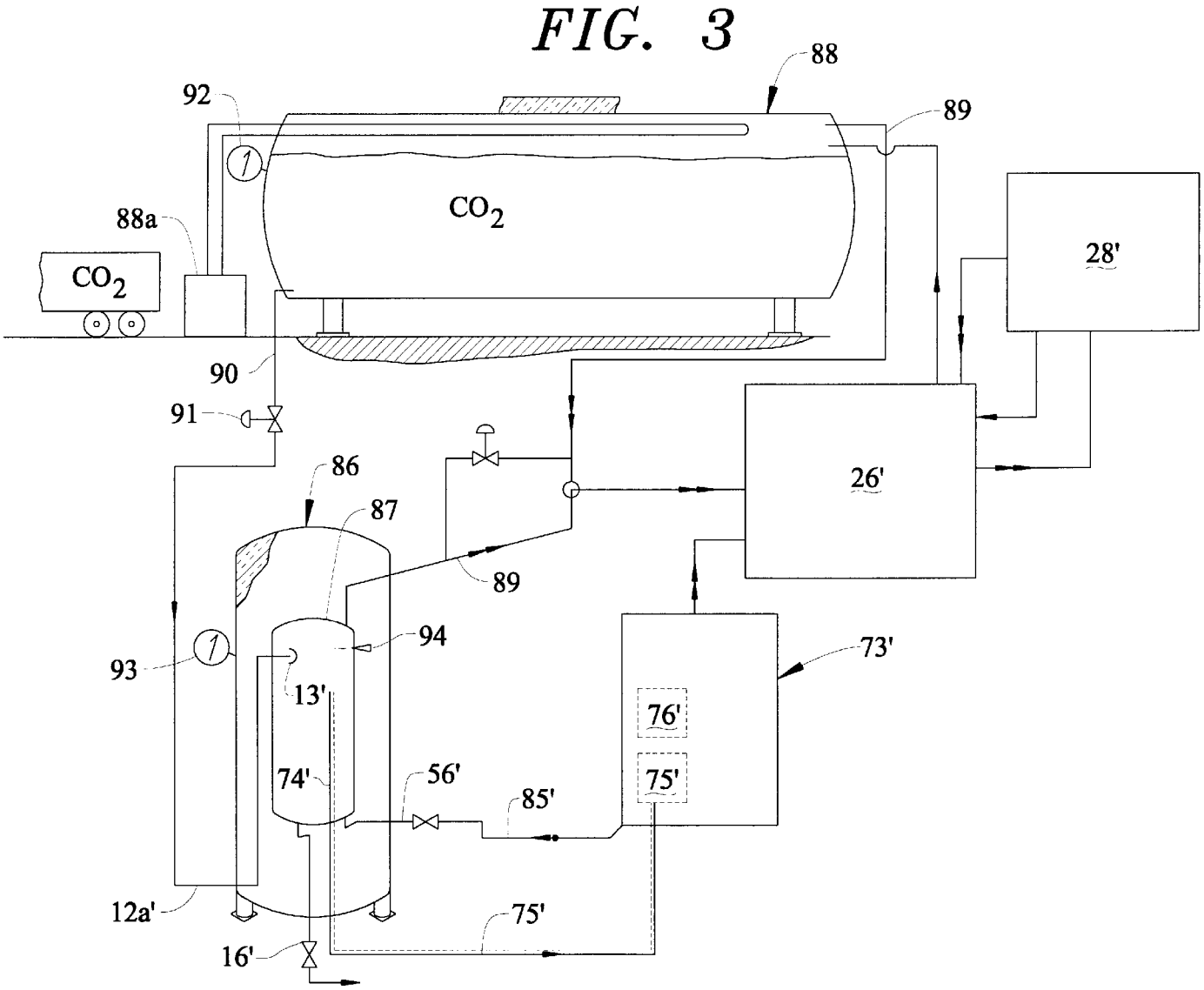
FIG. 3 is a diagrammatic/schematic view of the invention used in a system containing more than one $CO_2$ storage vessel.

Illustrated in FIG. 3 is the invention used at a site where two (or more, but not shown) $CO_2$ storage vessels (usually of different capacities) are provided, and with at least one storage vessel containing liquid $CO_2$ at a higher pressure/temperature than the other. Satellite vessel system 86, can be arranged so as to contain low pressure/low temperature liquid $CO_2$ by providing compressor skid 26' and refrigeration skid 28', connected much the same as in FIG. 1. However, to arrange satellite vessel 86 to contain low temperature/high pressure liquid $CO_2$, the bottom chill unit 73' of FIG. 2 must be added, as shown. Satellite storage vessel 86, having an inner vessel 87, is connected to the "mother" storage vessel 88 (shown as a horizontal vessel of the type in common use, with an integral refrigeration unit 88*a*) by a vapor line 89 and a liquid line 90. Line 90 may include, if desired, a pump (not shown) and a control valve 91, so the deliveries of liquid $CO_2$ into vessel 88 can be subsequently transferred to satellite vessel 86 as needed. While vessels 88 and 86 are shown with different piping and other arrangements, vessel 10 of FIG. 1 could be substituted for vessel 88. Vapor line 89 may serve to relieve pressure during transfer of liquid $CO_2$ into vessel 86 or to serve to provide vapor $CO_2$ during periods of heavy liquid $CO_2$ draw from vessel 86. Contents gauges/controls 92 and 93 provide the coordination for the necessary functions of temperature control 75' to control panel 76'. Vessels 86 and 88 can each have their own refrigeration equipment (as shown) or share (not shown). In the preferred arrangement, vessel 86 resembles the lower portion of vessel 10 of FIG. 2, and is sized sufficiently large to accommodate the user's needs. Accordingly, the normal position of the thermocline is near the top of the inner vessel 87. Vessel system 86 is always filled with the top branch fill line (line 12*a*') and line 74' extends to just below the level of liquid $CO_2$ maintained in vessel 87 by level control 94. By this means, a large pool of sub-cooled liquid $CO_2$ can be prepared for use and act as a reservoir for the user. Should pressures higher than the average safe working pressure of vessel 88 (about 325 psig) be desired, the system can be arranged to provide pressures up to 500 psig by variations of this aspect (not shown).

Figure 4C:
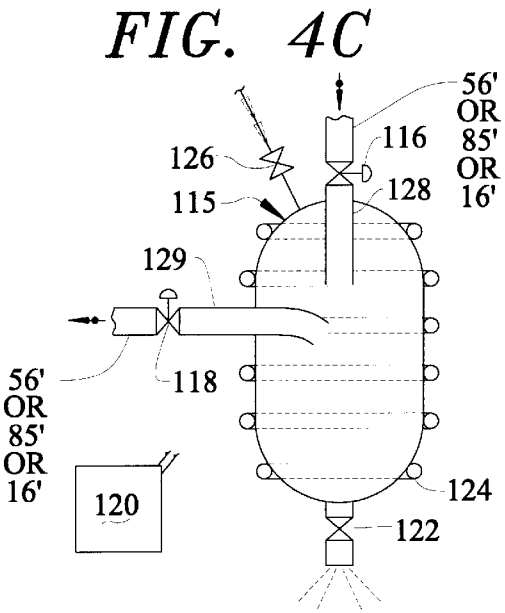
FIGS. 4, 4A, 4B and 4C are views of a vehicle delivery of liquid $CO_2$ and various contaminant removal devices.
Figure 4B:
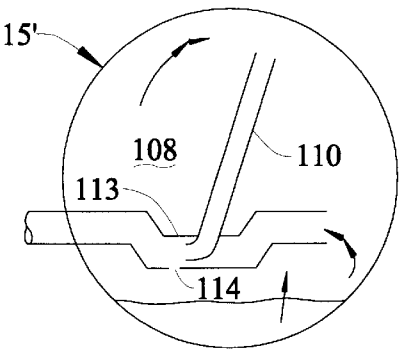
Figure 4:
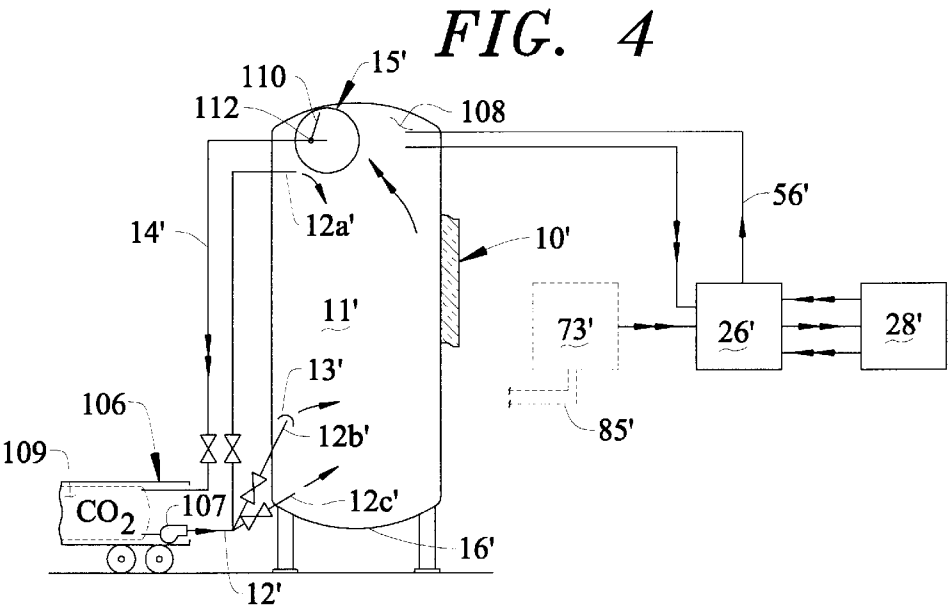

Turning next to FIG. 4, a truck or rail car 106 is delivering liquid $CO_2$ to a ground support/filling system (FIG. 1 or FIG. 2) containing a vessel system 10', utilizing, as is normal to the industry, a transfer pump 107 to force liquid $CO_2$ from the truck/car into the inner vessel 11', through any of the branch lines (12*a*', 12*b*' or 12*c*') connected to fill line 12'. Accordingly, the delivery operator is able to direct the flow of delivered liquid $CO_2$ into different levels of inner vessel 11', all as the operator determines best from a number of factors, in order to prevent under or overpressure of any liquid $CO_2$ containing vessel (including truck/car 106) during this process. Thus it is possible to maintain pressure in the vessel 11' of over 200 psig and have a liquid temperature in the bottom of the vessel of near −65° F. As the liquid $CO_2$ is pumped into vessel 11', the liquid, being denser, seeks the lower portion and the vapor seeks the upper or ullage 108 portion of vessel 11'. Vapor line 14' is typically connected into the ullage or vapor space 109 of the truck/car 106, so that vapor from vessel 11' can be returned to the truck/car 106 as controlled by the filling operator. Attached to the inlet of line 14' and located in the very top of the ullage volume 108 of inner vessel 11' is a scavenge system 15' which includes a top scavenge line 110, which interacts with that portion of line 14' that is inside vessel 11', through an aspirator 112. Non-condensables which may separate from the liquid $CO_2$ during the handling or cooling process or stray air, being typically lighter than the vapor $CO_2$, will tend to accumulate in that uppermost location. In addition any non-condensables that may accumulate in the bottom chill unit 73', the compressor unit 26' or the refrigeration unit 28' (or elsewhere) are directed back to this same location. Liquid $CO_2$ delivery trucks/cars typically effect a transfer of liquid $CO_2$ into the vessel system 10' and receive a near equal volume transfer of vapor back from the vessel system 10'. Thus the use of the scavenge system returns all the non-condensables along with the returned $CO_2$ vapor, back to the liquid $CO_2$ production plants, which are equipped to sense and dispose of them, and thus prevents them from blocking the condensing action of refrigeration unit 28'.

Figure 4A:
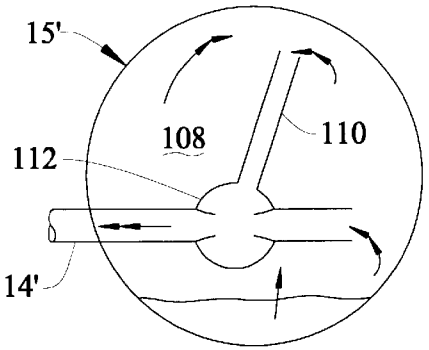

FIG. 4A is an enlarged diagrammatic/schematic view of one type of scavenge system 15', containing a choke type aspirator 112 where the flow of vapor back through the line 14' to the truck/car 106 during delivery of liquid $CO_2$ causes a lowered pressure at the aspiration point due to the velocity of the vapor passing the orifice(s), and thereby aspirates a flow of vapor/non-condensables through line 110. This inlet to the aspirator is at or near the top of the ullage volume 108 of vessel 11'. The geometry of the aspirator 112 is such that if liquid $CO_2$ were to pass through the aspirator 112, the aspiration effect would be largely lost, thus always maintaining a near 100% $CO_2$ vapor/non-condensable content of the ullage volume, an important safety consideration, as it is very unsafe to allow a liquid $CO_2$ vessel to become liquid full.

FIG. 4B is also an enlarged diagrammatic/schematic view of a second type of scavenger 15', containing trapped aspirator 113 wherein the aspiration action also largely ceases if the scavenger 15' receives liquid $CO_2$, as it forms a liquid full trap, preventing further aspiration until the trap is able to drain itself clear through drain hole 114. There are also a number of other possible arrangements which achieve the desired aspiration and scavenge action and which ceases when liquid $CO_2$ reaches it.

FIG. 4C is a trap 115 for collecting other type of contaminants that may separate from the $CO_2$, that is, condensables that have agglomerated, both those lighter and those heavier than the liquid $CO_2$ they are present in. Due to the wide variety and complexity of the byproduct plants which supply most of the commercial $CO_2$ in the world, almost every imaginable contaminant has been found in commercial $CO_2$ at one time or another. Such contaminants, if allowed to remain in the liquid $CO_2$ frequently cause malfunctions in the dispensing devices or the supply equipment. Trap 115 (in the form of a small tank) is preferably placed in return line 56', bottom chiller line 85', or withdrawal line 16', or any other line that may have such impurities. Liquid $CO_2$ enters the trap 115, where the impurities tend to accumulate and can be later discharged from the system. The inlet is selectively opened or closed by isolation valve 116 and the exit is selectively opened or closed by isolation valve 118, all as programmed into the control panel 120, or operated manually (not shown). A drain valve 122 is provided so that periodically, once the isolation valves 116 and 118 are closed, the drain valve 122 can be opened and the accumulated impurities discharged from the system; all under the influence of either or both heat and pressure, being heated by heaters 124 and high pressure blow out $CO_2$ vapor entering through valve 126, which communicates to a higher pressure $CO_2$ vapor regime elsewhere in the system (not shown). Since the trap 115 may contain impurities that sink to its bottom and/or impurities that may float to its top, trap entry line 128 extends into the interior of trap 115. In addition, the exit line 129 is arranged to be both below its operating liquid level but above its bottom, so that both floating and sinking types of contaminants tend to remain in the trap for later disposition. A standard type refrigerant float valve maintains the liquid level within the trap 115 at the proper point (not shown). Typically, the inside diameter of the trap is at least 4 times that of the inside diameter of the inlet line 128 and its height is at least 3 times its diameter, the trap 115 being mounted in a vertical position. All this ensures low enough velocities that both density contaminants remain in the trap until blown out.

Figure 5:
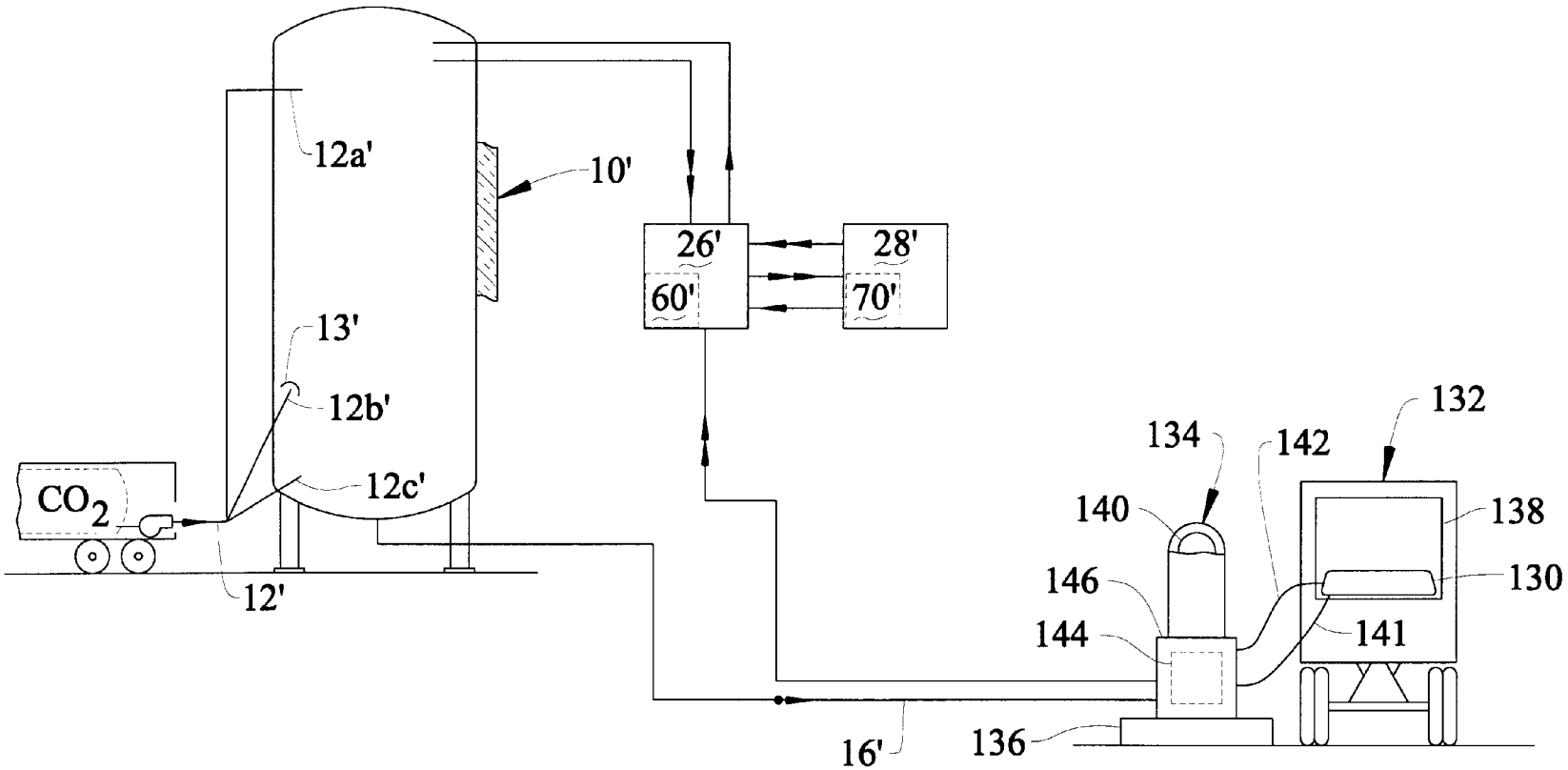
FIG. 5 is a diagrammatic/schematic view of filling low pressure $CO_2$ tanks on refrigerated trucks.

FIG. 5 depicts a variation of the invention which is especially useful for filling the low pressure liquid $CO_2$ tanks 130 (near 125 psig) carried onboard refrigerated vehicles 132 and the like, for enroute cooling. For a number of reasons, it is desired that the liquid $CO_2$ being supplied be near the equilibrium temperature for that pressure (about −42° F.). For such service, vessel system 10', compressor unit 26' and refrigeration unit 28', arranged as shown in FIG. 1, is very suitable. The control panels 60' and 70' are set so that storage vessel 10' is maintained near 125 psig and the liquid temperature then comes into equilibrium, as the system functions. It is desired, that is as normal for such users, that storage vessel 10' never be allowed to totally run out of liquid $CO_2$. Thus, when vessel 10' needs to be replenished, the driver of delivery unit or operator (bringing higher pressure/warmer liquid $CO_2$), does not fill using the branch line 12*c*' of fill line 12' that enters the bottom of the vessel 10', thus not disturbing the near −42° F. liquid remaining there. He would use either the intermediate 12*b*' or top branch line 12*a*' of fill line system 12' as appropriate, thereby creating a temporary thermocline and an inventory of cold liquid $CO_2$. In filling such tanks as 130, the temperature of the liquid $CO_2$ is the more critical of temperature or pressure, as sub-cooled liquid tends to depressurize easily. By filling in such a manner, the compressor unit 26' and the refrigeration unit 28', working in concert, gradually bring the pressure and temperature down to the desired 125 psig and the desired −42° F.; but without causing the user to have to wait (as would occur if the liquid $CO_2$ were delivered into the bottom of vessel 10'). Turning to the practical problems encountered in filling such tanks 130, which usually are integral parts of the refrigerated vehicle 132, it is desirable that the vehicles receive their liquid $CO_2$ at a convenient to reach location, and also where they can receive fuel and other such needs—fuel, air, oil, liquid $CO_2$, etc. at one location and at one time. For liquid $CO_2$ cooled trucks 132, one favored concept is to have a so-called large "mother vessel" 10', conveniently located for truck/trailer/rail car refilling, which is connected to one or more small satellite filling stations 134, each located on a service island 136, which like a modern gasoline filling station, contains all the needed services for a departing liquid $CO_2$ refrigerated truck (or trailer, container, rail car or the like). Such a refrigerated vehicle 132 is shown at such a satellite filling station 134, having a $CO_2$ cooling unit 138 mounted in its nose and which contains a small liquid $CO_2$ tank 130, holding typically 500 to 1,000 lbs. of liquid $CO_2$ for later use as the enroute expendable refrigerant. A satellite vessel 140, sized to be at least slightly larger than any tank 130 to be filled, holds a ready supply of liquid $CO_2$ at near 125 psig. Vessel 140 can be connected to tank 130 with a liquid line 141 and optionally, vapor line 142. Control system 144 (located inside of cabinet 146) monitors and controls the filling and transfer of liquid $CO_2$ both into and from satellite vessel 140 to the tank 130. Satellite vessel 140 can be filled with liquid $CO_2$ (using line 16') and by returning vapor from its top to the compressor unit 26' (partially shown). Tank 130 can be filled from vessel 140 by venting the vapor side of tank 130 (or by running cooling unit 138 with vapor), or by other arrangements.

Figure 6:
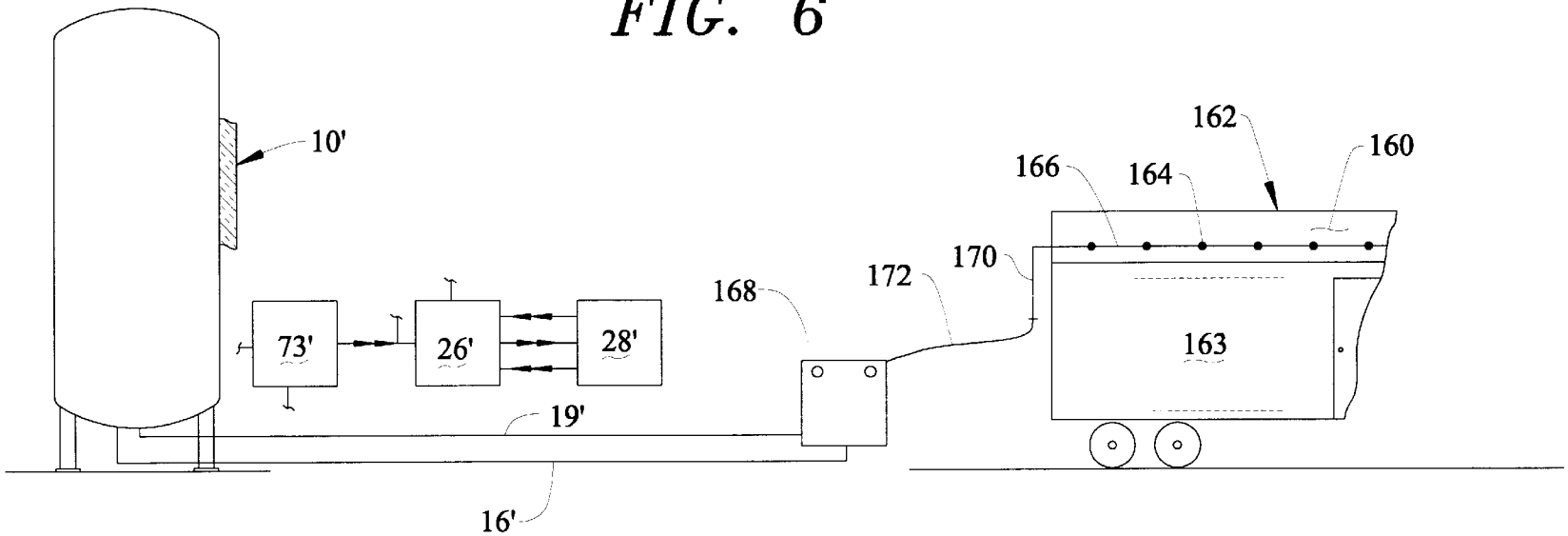
FIGS. 6 and 6A are diagrammatic/schematic views of filling dry ice bunkers of refrigerated rail cars.

Turning next to FIG. 6, a favored arrangement is depicted where the dry ice bunker 160 of a refrigerated rail car 162 is to be filled with dry ice snow. Such cars 162 are normally loaded with frozen cargo 163, then the bunker is filled with dry ice, using liquid $CO_2$. The flash gas is directed around the cargo, so as to cool the car walls and floor and the perimeter of the cargo before exiting the car 162. The dry ice snow remaining in the bunker 160 provides the principal enroute refrigeration. Significant reductions in liquid $CO_2$ requirements are possible by utilizing very cold liquid $CO_2$, i.e. that near the triple point temperature of −69° F. However, the liquid $CO_2$ is injected into the bunker 160 typically through orifices 164 placed in the manifold 166 along the length of the bunker 160. The orifices direct and meter the flow of the liquid $CO_2$ so the snow evenly fills the bunker 160. Orifices 164 are by their nature always open, and thus the manifold 166 is near atmospheric pressure prior to the incoming flow of the liquid $CO_2$. Lines 19' ($CO_2$ vapor) and 16' (cold liquid $CO_2$) or extensions thereof connect vessel 10' to fill station 168. If it is desired to use liquid $CO_2$ near the triple point temperature for filling the bunker 160 (because of its efficiency in making dry ice); as soon as flow of such liquid commences, the leading cold liquid $CO_2$ becomes depressurized sufficiently to cause $CO_2$ snow to be created within the manifold 166, the manifold extension 170 or the connection hose 172. This snow then is carried to the orifices 164 so that they become clogged and inoperative. Furthermore, very fast $CO_2$ flow rates are desired (so as to not delay the already loaded rail car), thus a high differential pressure over the triple pont pressure (near 60 psig) is desired, as can best be provided by having a large inventory of sub-cooled liquid $CO_2$ in storage vessel 10'. Accordingly, the invention as shown in FIG. 2 or FIG. 3 is desired, where such an amount of sub-cooled liquid can be available. Vessel system 10' (or vessel 86' not shown), compressor unit 26', refrigeration unit 28' and bottom chill unit 73' are cooperatively connected. When it is desired to fill the bunker 160 with snow, fill station 168 is connected to manifold extension 170 by means of connection hose 172.

Figure 6A:
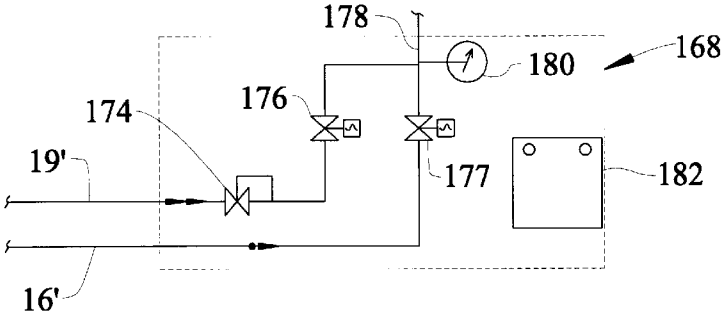

As best seen in FIG. 6A, vapor line 19' connects inside fill station 168 with a downstream pressure regulator 174 (set at least above about the triple point pressure of $CO_2$) and solenoid valve 176. Liquid $CO_2$ line 16' is connected to solenoid valve 177, and the outlets of both connect together into discharge line 178. The pressure in line 178 is monitored by pressure switch 180. Control panel 182, once it is desired to initiate flow of liquid $CO_2$ so as to fill the bunker 160, first opens valve 176, allowing $CO_2$ vapor to flow into the manifold 166 and raise its pressure. Pressure switch 180 monitors the pressure in line 178, making certain that valve 177 does not open until the pressure in line 178 (which is openly connected to hose 172, line 170, manifold 166 and orifices 164) is near or above the triple point pressure; whereby the flow of the near triple point liquid $CO_2$ can commence at a high rate without forming a clogging snow. Recommended practice would be to utilize ball type valves and long radius elbows wherever very cold liquid $CO_2$ is expected to rapidly flow. At the conclusion of the bunker 160 filling operation (either determined by time, or by volume or by weight or any other method desired); it is preferable to reverse the process and first shut valve 177, then delay so as to force the residual liquid $CO_2$ laying in the manifold, etc. out the orifices 164 with $CO_2$ vapor, then shut valve 176. This system would be of value to a number of other types of snow making operations or devices which use snow as a cooling medium. If the valve widely used in the $CO_2$ industry and known as the PRASO (Pressure Responsive Automatic Shut Off) valve (not shown) replaces the orifices 164, such pre-pressurization can be reduced, depending upon the size and geometry of the piping and valves which the cold liquid $CO_2$ is to flow through.

Although the invention has been described with regard to what is believed to be the preferred embodiment, changes and modifications as would be obvious to one having ordinary skill in both refrigeration and $CO_2$ art can be made to the invention without departing from its scope. Particular features are emphasized in the claims which follow. The term conduit used in the following claims is to interpreted broadly to include pipe, tube, valve, pump and other devices used for the transfer of fluid or vapor.

I claim:

1. In a ground support/filling system designed to deliver liquid carbon dioxide at various temperatures to a using device, which system comprises an insulated vessel for receiving and storing liquid carbon dioxide from a vehicle, first conduit means for supplying said liquid carbon dioxide to said vessel, a refrigeration system associated with said vessel, said refrigeration system using another refrigerant than carbon dioxide and including an evaporator for condensing carbon dioxide vapor, a compressor and a condenser, second conduit means for removing carbon dioxide vapor from said vessel, a carbon dioxide compressor for raising the pressure of said removed carbon dioxide vapor by at least 5 psi before it is to be condensed by said evaporator and third conduit means for delivering said liquid carbon dioxide from said vessel to said using device the improvement comprising an arrangement in which said removed and compressed carbon dioxide vapor is cooled to near its saturation temperature before reaching said evaporator by being bubbled through a separate pool of liquid carbon dioxide, whereby the cooling side of said evaporator operates principally as a saturated carbon dioxide vapor condenser, removing whatever amount of heating the carbon dioxide vapor to be condensed experienced during compression and/or transfer, as the carbon dioxide vapor becomes de-superheated, so that said refrigeration system maintains a predicted cooling capacity, and whereby liquid carbon dioxide can be delivered to said using device at a selected temperature as low as about −69° F. and at a pressure above about 61 psig, which pressure is at or above the equilibrium pressure for the selected temperature, so that liquid carbon dioxide at an optimus low temperature may be delivered therefrom to said using device.

2. The apparatus of claim 1 wherein said first first conduit means has a plurality of entries into said storage vessel at different vertical levels and includes valve means for selectively opening said entries, whereby said vessel may be replenished by feeding liquid carbon dioxide into said vessel without disturbing the temperature of the liquid carbon dioxide already in the lower portion of said storage vessel.

3. The apparatus of claim 1 wherein said first conduit means also includes a conduit arranged to return scavenged non-condensable contaminants accumulating in the ullage volume of said storage vessel to said delivery vehicle supplying said liquid carbon dioxide, whereby such contaminants do not interfere with the operation of said refrigeration system.

4. The apparatus of claim 1 wherein said third conduit means includes a separator to remove any condensable contaminants carried in said liquid carbon dioxide, whereby such condensable contaminants may be separated from the liquid carbon dioxide before such contaminants interfere with the operation of any said using device.

5. The apparatus according to claim 1 wherein said insulated vessel is comprised of a first insulated vessel and a second insulated vessel connected by a fourth conduit means, and said second conduit means removes said carbon dioxide vapor from said second insulated vessel and said third conduit means delivers said liquid carbon dioxide from said second vessel, whereby said liquid carbon dioxide can be received and stored at one temperature into one vessel and received and stored in a second vessel and then delivered to said using device at a lower temperature than that of said liquid carbon dioxide in said first vessel.

6. In a ground support/filling system designed for operation to either deliver sub-cooled liquid carbon dioxide or alternately to deliver cold liquid carbon dioxide to a using device, which system comprises an insulated vessel for receiving and storing liquid carbon dioxide and for accumulating and storing either sub-cooled or cooled liquid carbon dioxide, first conduit means for supplying said liquid carbon dioxide to said vessel, a first refrigeration system associated with said vessel designed to cool the liquid carbon dioxide therein, second conduit means for removing liquid carbon dioxide from a middle region of said vessel, a second refrigeration system associated with said second conduit for cooling said removed liquid carbon dioxide, third conduit means for returning said cooled liquid carbon dioxide to a lower region of said vessel and fourth conduit means for delivering said liquid carbon dioxide in either sub-cooled or cold condition from said vessel to said using device, the improvement comprising, said second refrigeration system operates to cool said removed liquid carbon dioxide by depressurization, whereby said liquid carbon dioxide may be removed from said middle region and cooled by removing carbon dioxide vapor, thereby omitting the inefficiencies of a heat exchanger and producing lower temperatures without fear of carbon dioxide solidification, and whereby depending upon the manner in which said ground support/filling system is operated, either sub-cooled or cold liquid carbon dioxide can be delivered at a pressure above about 61 psig and a temperature between about −69° F. and about −25° F., which pressure is at or above the equilibrium pressure for such selected temperature, so that liquid carbon dioxide at the optimus pressure and temperature for said using device may be delivered therefrom.

7. The apparatus according to claim 6 wherein said first conduit means for supplying liquid carbon dioxide to said vessel includes liquid carbon dioxide supply means to said vessel from a vehicle and carbon dioxide vapor return means from said vessel to said vehicle so as to control the pressures within said vessel and said vehicle during such supply operation, whereby said vehicle will not be cooled by depressurization to a temperature below said vehicle's safe limits.

8. The apparatus according to claim 7 wherein said first conduit means has a plurality of entries into said storage vessel at different vertical levels and includes valve means for selectively opening said entries, whereby said vessel may be replenished by feeding liquid carbon dioxide into said vessel without disturbing the temperature of the liquid carbon dioxide already in the lower portion of said vessel and while allowing the pressure in said vehicle to be maintained sufficiently high during replenishment so as to prevent temperatures below about −20° F. occurring within said vehicle even if the pressure in said vessel is between about 225 psig and about 66 psig.

9. The apparatus according to claim 7 wherein said first conduit means also includes a conduit arranged to return scavenged non-condensable contaminants accumulating in the ullage volume of said storage vessel to said delivery vehicle supplying said liquid carbon dioxide, whereby such contaminants do not interfere with the operation of said refrigeration system.

10. The apparatus of claim 6 wherein either or both said third or fourth conduit means includes a separator to remove any condensable contaminants carried in said cooled liquid carbon dioxide, whereby condensable contaminants may be separated from the liquid carbon dioxide before such contaminants interfere with the proper operation of said conduit system carrying cooled liquid or of said using devices.

11. In a ground support/filling system designed to deliver sub-cooled liquid carbon dioxide to a using device, which system comprises an insulated first vessel for receiving and storing liquid carbon dioxide from a vehicle, first conduit means for supplying said liquid carbon dioxide to said first vessel, a mechanical refrigeration system associated with said first vessel for condensing carbon dioxide vapor therefrom;

an insulated second vessel for receiving liquid carbon dioxide from said first vessel and for accumulating and storing cooled liquid carbon dioxide, second conduit means for supplying liquid carbon dioxide from said first vessel to said second vessel, a second refrigeration system associated with said second vessel, including a compressor that cools the liquid carbon dioxide in said second vessel by evaporative cooling and returning the resultant carbon dioxide vapor to said first vessel and third conduit means for supplying liquid carbon dioxide to said using device from said second vessel, the improvement comprising (a) a liquid level control system to maintain a desired level of liquid carbon dioxide in an upper region of said second vessel, (b) said second refrigeration system including a fourth conduit system for removing liquid carbon dioxide from a middle region of said second vessel and cooling said removed liquid carbon dioxide by removing carbon dioxide vapor with said compressor, and after cooling said liquid carbon dioxide, returning it to a lower region of said second vessel and (c) a pressure control system using carbon dioxide vapor from the system so as to maintain a pressure in said second vessel at least 5 psi higher than the equilibrium pressure of said liquid carbon dioxide cooled in said fourth conduit by vapor removal by said compressor, whereby liquid carbon dioxide may be removed from said middle region and cooled by removing carbon dioxide vapor from it without the inefficiencies of a heat exchanger and lower carbon dioxide temperatures can be produced without fear of carbon dioxide solidification, and whereby depending upon the manner in which said ground support system is operated, sub-cooled liquid carbon dioxide can be continuously delivered at a temperature between about −69° F. and about −25° F. and a pressure above about 61 psig, which pressure is at least about 5 psi above the equilibrium pressure for such selected temperature, so that sub-cooled liquid carbon dioxide at the optimus pressure and temperature for said using device may be delivered therefrom, and whereby the stored sub-cooled liquid carbon dioxide being supplied to said using device from said second vessel can be replaced at the same time by said second refrigeration system without interfering with the constant supply and temperature and pressure condition of sub-cooled liquid carbon dioxide to said using device.

12. The apparatus according to claim 11 wherein said second refrigeration system includes a mechanical refrigeration system, whereby said carbon dioxide vapor removed by said second refrigeration system is cooled before being returned to said first vessel.

13. The apparatus of claim 11 wherein said first conduit means for supplying liquid carbon dioxide to said first vessel includes means to supply liquid carbon dioxide to said first vessel from a vehicle and to return carbon dioxide vapor from said vessel to said vehicle so as to control the pressures within said vessel and said vehicle during such supply operation.

14. The apparatus of claim 11 wherein said first conduit means includes a conduit arranged to return scavenged non-condensable contaminants accumulating in the ullage volume of said first vessel to said delivery vehicle supplying said liquid carbon dioxide, whereby such contaminants do not interfere with the proper operation of said refrigeration system.

15. The apparatus of claim 11 wherein either or both said second or said third conduit means includes a separator to remove condensable contaminants carried in said liquid carbon dioxide, whereby condensable contaminants may be separated from the liquid carbon dioxide before such contaminants interfere with the operation of said conduit systems carrying cooled liquid carbon dioxide or of said using device.

16. The apparatus of claim 11 wherein said second conduit means includes a liquid carbon dioxide pump, whereby pressures as high as about 500 psig can be maintained in said second vessel and sub-cooled liquid carbon dioxide can be supplied to said using device at pressures as high as about 500 psig.

17. A method of receiving liquid carbon dioxide and cooling said liquid carbon dioxide to temperatures between about −69° F. and about −25° F. and storing said cooled liquid carbon dioxide for use with a liquid carbon dioxide using device at a ground support/filling station, comprising the steps of:

(a) receiving and storing liquid carbon dioxide in an insulated vessel, (b) cooling said liquid carbon dioxide in said vessel by evaporative cooling utilizing a carbon dioxide compressor to remove carbon dioxide vapor, (c) condensing the carbon dioxide vapor resulting from such evaporative cooling and returning such condensed vapor to said vessel, (d) furnishing said cooled liquid carbon dioxide to a liquid carbon dioxide using device from a lower outlet in said vessel and (e) replenishing the supply of liquid carbon dioxide in said vessel in a manner that does not warm all the already cooled liquid carbon dioxide in the lower section of said vessel, whereby liquid carbon dioxide can be delivered to a using device at temperatures between about −69° F. and about −25° F. and replenishment can occur without warming all the already cooled and stored liquid carbon dioxide, so that the operation of the using device is not interfered with by said replenishment.

18. The method in accordance with claim 17 wherein sub-cooled liquid carbon dioxide is supplied by said ground support/filling station comprising the additional steps of:

(a) removing said liquid carbon dioxide to be cooled from a middle section of said vessel and then cooling said removed liquid carbon dioxide by said evaporative cooling utilizing said carbon dioxide compressor, (b) returning said removed and cooled liquid carbon dioxide to a lower region of said vessel thereby creating a thermocline of warmer liquid carbon dioxide above said cooled liquid carbon dioxide and (c) maintaining the pressure in said insulated storage vessel at least 5 psi higher than the equilibrium pressure of said removed, cooled and returned liquid carbon dioxide, whereby depending upon the manner in which said ground support/ filling system is operated, sub-cooled liquid carbon dioxide can be delivered to a using device at a selected temperature of between about −69° F. and about −25° F., and at a pressure above about 66 psig, but which pressure is at least about 5 psi above the equilibrium pressure for such selected temperature, so that liquid carbon dioxide at an optimus temperature and pressure may be delivered therefrom to a using device.

19. The method in accordance with claim 17 wherein a vehicle is being utilized to supply replenishment liquid carbon dioxide to said ground support/filling station, comprising the additional steps of:

(a) connecting said vehicle's vapor space to said vessel's vapor space, (b) connecting said vehicle's liquid space to a space in said vessel that is lower than said vessel's said vapor space and (c) transferring said replenishment liquid carbon dioxide in a manner that prevents temperatures below about −20° F. occurring within said vehicle, even if the pressure in said vessel is below about 225 psig and as low as about 66 psig, whereby said vehicle will not be cooled by depressurization to a temperature below said vehicle's safe limits.

20. A method of receiving liquid carbon dioxide, cooling said liquid carbon dioxide to temperatures between about −69° F. and about −25° F. and storing said cooled liquid carbon dioxide at a ground support/filling station for use by a liquid carbon dioxide using device, comprising the steps of:

(a) supplying liquid carbon dioxide to and storing said liquid carbon dioxide in a first insulated vessel, (b) transferring some of said stored liquid carbon dioxide to a second insulated vessel, (c) cooling said liquid carbon dioxide in said second vessel by evaporative cooling utilizing a carbon dioxide compressor, (d) condensing said vapor resulting from said evaporative cooling and returning said condensed vapor to either said first or second vessel, (e) furnishing said cooled liquid carbon dioxide to a using device from a lower outlet in said second vessel and (f) replenishing the supply of liquid carbon dioxide in said second vessel in a manner that does not warm the already cooled liquid carbon dioxide in said second vessel;

whereby liquid carbon dioxide can be supplied in a normal manner to said first vessel, then transferred to said second vessel wherein it can be cooled to temperatures between about −69° F. and about −25° F., so that liquid carbon dioxide at an optimus temperature and pressure may be supplied therefrom to a using device.

21. The method in accordance with claim 20 wherein sub-cooled liquid carbon dioxide is supplied by said ground support/filling station comprising the additional steps of:

(a) removing said liquid carbon dioxide to be cooled from a middle section of said second vessel (b) cooling said removed liquid carbon dioxide by said evaporative cooling (c) returning said removed and cooled liquid carbon dioxide to a bottom section of said second vessel, thereby creating a thermocline of warmer liquid carbon dioxide above said cooled liquid carbon dioxide and (d) maintaining the pressure in said second vessel at least 5 psi higher than the equilibrium pressure of said removed, cooled and returned liquid carbon dioxide, whereby depending upon the manner in which said ground support/filling station is operated, sub-cooled liquid carbon dioxide can be delivered to a using device at a selected temperature of between about −69° F. and about −25° F., and at a pressure above about 66 psig, but which pressure is at least about 5 psi above the equilibrium pressure for such selected temperature, so that sub-cooled liquid carbon dioxide at an optimus temperature and pressure may be delivered therefrom to a using device.

22. A method of receiving liquid carbon dioxide and cooling or sub-cooling said liquid carbon dioxide to temperatures between about −69° F. and about −25° F. and storing said cooled or sub-cooled liquid carbon dioxide for use with a liquid carbon dioxide using device at a ground support/filling station, comprising the steps of:

(a) receiving and storing liquid carbon dioxide in an insulated vessel, (b) cooling said liquid carbon dioxide in said vessel by evaporative cooling utilizing a carbon dioxide compressor to remove carbon dioxide vapor, (c) bubbling said removed and compressed carbon dioxide vapor through a separate pool of liquid carbon dioxide cooling said vapor to near its saturation temperature, (d) condensing said removed, compressed and cooled carbon dioxide vapor in a mechanical refrigeration system and returning such condensed vapor to said vessel, (e) furnishing said cooled or sub-cooled liquid carbon dioxide to a liquid carbon dioxide using device from a lower outlet in said vessel and (f) replenishing the supply of liquid carbon dioxide in said vessel in a manner that does not warm the already cooled or sub-cooled liquid carbon dioxide in the lower section of said vessel, whereby said refrigeration system principally condenses saturated carbon dioxide vapor thereby maintaining a predicted condensing capacity, and whereby liquid carbon dioxide can be delivered to a using device at temperatures between about −69° F. and about −25° F. and replenishment can occur without warming the already cooled or sub-cooled and stored liquid carbon dioxide, so that the operation of the using device is not interfered with by said replenishment.

23. In a ground support/filling system designed to deliver sub-cooled liquid carbon dioxide at various temperatures and pressures to a using device, such as but not limited to trucks or rail cars using carbon dioxide for cooling, which system comprises an insulated vessel for receiving and storing sub-cooled liquid carbon dioxide, first conduit means for supplying liquid carbon dioxide to a portion above the bottom portion of said vessel, second conduit means for supplying sub-cooled liquid carbon dioxide from said bottom portion of said vessel to said using device, the improvement comprising (a) a refrigeration system including a third conduit system for removing liquid carbon dioxide from a portion above said bottom portion of said vessel and cooling said removed liquid carbon dioxide by reducing its pressure by at least 5 psi and removing any resultant carbon dioxide vapor with a carbon dioxide compressor, and after cooling said liquid carbon dioxide, a fourth conduit system for raising the pressure of said cooled liquid carbon dioxide is in a sub-cooled state and returning said sub-cooled liquid carbon dioxide to said bottom portion of said vessel and (b) a fifth conduit system for collecting said compressed carbon dioxide vapor so it may subsequently be used as a vapor or condensed to a liquid state for further use, whereby liquid carbon dioxide may be removed from said vessel and cooled by removing carbon dioxide vapor from it without the inefficiencies of a heat exchanger and lower carbon dioxide temperatures can be produced without fear of carbon dioxide solidification, and then returned, and whereby depending upon the manner in which said ground support system is operated, sub-cooled liquid carbon dioxide can be continuously delivered at a temperature between about −69° F. and about −25° F. and a pressure above 65 psig, which pressure is at least about 5 psi above the equilibrium pressure for such selected temperature, so that sub-cooled liquid carbon dioxide at the optimus pressure and temperature and reduced carbon dioxide usage for said using device may be delivered therefrom, and whereby the stored sub-cooled liquid carbon dioxide being supplied to said using device from said vessel can be simultaneously replaced with liquid carbon dioxide and with sub-cooled liquid carbon dioxide by said refrigeration system without interfering with the constant supply of sub-cooled liquid carbon dioxide from said vessel to said using device.

24. A method of receiving liquid carbon dioxide and cooling said liquid carbon dioxide to a temperature between about −69° F. and about −25° F. and storing said cooled liquid carbon dioxide in a sub-cooled state for use with a liquid carbon dioxide using device, such as, but not limited to trucks or rail cars using carbon dioxide for cooling, at a ground support/filling station, comprising the steps of:

(a) receiving and storing liquid carbon dioxide in an insulated vessel, (b) removing said liquid carbon dioxide from a portion of said vessel above the bottom portion, (c) cooling said removed liquid carbon dioxide by depressurization and creating carbon dioxide vapor, (d) raising the pressure of said cooled liquid carbon dioxide and returning it in a sub-cooled state to a bottom portion of said vessel, (e) furnishing said sub-cooled liquid carbon dioxide to a liquid carbon dioxide using device from an outlet located in a bottom portion of said vessel and (f) replenishing the supply of liquid carbon dioxide in said vessel in a manner that does not warm the reservoir of sub-cooled liquid carbon dioxide already in the lower portion of said vessel, whereby sub-cooled liquid carbon dioxide can be delivered to a using device at a temperature between about −69° F. and about −25° F. from said vessel, and both replenishment with liquid carbon dioxide without warming the already stored sub-cooled liquid carbon dioxide and replenishment with sub-cooled liquid carbon dioxide, can all occur simultaneously so the supply of sub-cooled liquid carbon dioxide to said using device is not interfered with by said replenishments.

* * * * *